US005110101A

United States Patent [19]

Roth

[11] Patent Number: 5,110,101

[45] Date of Patent: May 5, 1992

[54] APPARATUS FOR SUBDIVIDING A RUNNING WEB OF COHERENT PANELS IN ZIG-ZAG FORMATION

[75] Inventor: Oscar Roth, Waltenschwil, Switzerland

[73] Assignee: Involvo AG, Bünzen, Switzerland

[21] Appl. No.: 687,449

[22] Filed: Apr. 18, 1991

[30] Foreign Application Priority Data

Apr. 19, 1990 [CH] Switzerland ..... 1327/90

[51] Int. Cl.[5] ..... B41L 39/02

[52] U.S. Cl. ..... 270/39; 493/357; 493/410; 270/52.5; 225/104

[58] Field of Search ..... 270/31, 39, 52.5; 493/357, 356, 413, 414, 40, 41, 324; 225/103, 101, 93, 104; 83/660, 205, 278

[56] References Cited

U.S. PATENT DOCUMENTS

| | | | |
|---|---|---|---|
| 4,449,349 | 5/1984 | Roth | 53/66 |
| 4,747,591 | 5/1988 | Beyer | 270/52.5 |
| 4,750,724 | 6/1988 | Herd | 270/39 |
| 4,778,165 | 10/1988 | Buck | 270/39 |
| 4,842,572 | 6/1989 | Roth | 493/357 |
| 4,842,573 | 6/1989 | Peter | 270/39 |
| 4,871,157 | 10/1989 | Hermann | 270/39 |
| 4,917,365 | 4/1990 | Stemmler | 270/39 |

FOREIGN PATENT DOCUMENTS

| | | | |
|---|---|---|---|
| 131669 | 8/1982 | Japan | 270/31 |
| 112371 | 5/1988 | Japan | 270/31 |
| 288569 | 11/1989 | Japan | 270/31 |
| 261771 | 10/1990 | Japan | 270/31 |

*Primary Examiner*—Edward K. Look
*Assistant Examiner*—Therese M. Newholm
*Attorney, Agent, or Firm*—Peter K. Kontler

[57] ABSTRACT

Successive panels of a running web with panels in zig-zag formation are deflected into a duct wherein the panels gather into a growing pile on a vertically movable bottom wall. A severing tool is moved across the pile at a selected level above the bottom wall to sever the web along the fold line between two neighboring panels when the pile beneath the level of the severing tool reaches a preselected height. A spreading device is used to spread apart the panels immediately above and below the level of the severing tool to establish a clearance for entry of the tool. The panels above and below the clearance are clamped to prevent the tool from displacing and/or otherwise affecting such panels during penetration into the clearance and during severing of the web along the fold line between the panels immediately adjacent the clearance.

12 Claims, 4 Drawing Sheets

115
B
15
7'
21
18
15'
20
7
4'
2
A
4
M
7
8
9
5
10
11
107
107a
IV
7'
6
C
16
V
10
25
26
24
11
25
26
22
13
14
M2
1

APPARATUS FOR SUBDIVIDING A RUNNING WEB OF COHERENT PANELS IN ZIG-ZAG FORMATION

BACKGROUND OF THE INVENTION

The invention relates to improvements in apparatus of the type disclosed in commonly owned U.S. Pat. No. 4,842,572 granted Jun. 27, 1989. The disclosure of this patent is incorporated herein by reference.

The patent discloses an apparatus which can be used to convert a continuous web, consisting of a series of panels which are integrally connected to each other along transversely extending fold lines, into a series of stacks each of which can contain a predetermined number of panels or sheets (e.g., 500 sheets per stack). The web is advanced lengthwise in such a way that its panels are in zig-zag formation and partially overlap each other (to form a so-called scalloped or imbricated stream) on their way into a substantially upright duct wherein they gather into a growing pile. The lower portion of the pile is separated from the panel immediately above it (along the fold line between such panel and the panel immediately below it) so that the separated lower portion of the pile constitutes a stack which is thereupon removed from the apparatus for storage or wrapping. Each panel can constitute a printed form and can bear printed information at one or both sides. The web is or can be weakened along the fold lines (e.g., by transversely extending rows of perforations) to facilitate separation of superimposed panels from each other. The severing of the web can be initiated by a counter which generates a signal when the pile in the duct contains a predetermined number of overlapping panels at the level beneath the plane of the severing tool.

A drawback of presently known apparatus of the above outlined character is that the severing tool is likely to damage or deface the panels which are immediately adjacent the path of movement of the severing tool toward severing or breaking engagement with the folded portion of the web at a predetermined level above the bottom wall of the duct. The danger of damaging and/or defacing the panels which are adjacent the path of movement of the severing tool is particularly pronounced if the panels of the web are relatively thin and readily deformable sheets of paper or the like, e.g., panels which can be used as second, third, fourth, etc. copies of printed forms. If the web offers a rather pronounced resistance to severing by the leader of the tool, the leader is likely to extract the neighboring panels from the duct and to thus cause damage to additional panels in the duct.

OBJECTS OF THE INVENTION

An object of the invention is to provide an apparatus which constitutes an improvement over and a further development of the apparatus of U.S. Pat. No. 4,842,572 in that it can treat the overlapping panels of a zig-zag folded web gently irrespective of the thickness, dimensions and/or other characteristics of the panels.

Another object of the invention is to provide an apparatus which can reliably retain the panels of a pile of superimposed panels in optimum positions relative to each other irrespective of the speed at which the severing tool is caused to separate the topmost panel of a freshly gathered stack from the immediately following panel above it.

A further object of the invention is to provide the apparatus with novel and improved means for manipulating the panels which are adjacent the path of movement of the severing tool across the pile of superimposed panels in a duct.

An additional object of the invention is to provide a novel and improved method of clamping selected panels in the duct of the above outlined stack forming apparatus.

Still another object of the invention is to provide the apparatus with novel and improved means for establishing a path for unimpeded movement of the severing tool toward the location of breaking, severing or tearing engagement with the folded web.

A further object of the invention is to provide a novel and improved bottom wall for use in the duct of the above outlined apparatus.

An additional object of the invention is to provide the apparatus with novel and improved means for preventing undue flexing of panels in the duct at the locus of penetration of the severing tool in spite of the tendency of the growing pile in the duct to increase its height in the regions of superimposed fold lines between neighboring panels.

Another object of the invention is to provide an apparatus wherein the device or devices which clear the path for entry of the severing tool into a growing pile of overlapping panels in zig-zag formation can perform other important and desirable novel functions.

SUMMARY OF THE INVENTION

The invention is embodied in an apparatus for subdividing a continuous web of mutually inclined panels in zig-zag formation wherein neighboring panels are connected to each other along fold lines. The improved apparatus comprises a substantially upright duct having an inlet (e.g., an open top) and including spaced-apart first and second sidewalls and a bottom wall, means for advancing the web longitudinally toward and into the duct by way of the inlet so that the duct accumulates a growing pile of overlapping panels with the foremost (i.e., lowermost) panel of the pile resting on the bottom wall and the fold lines between successive panels alternatingly adjacent the first and second sidewalls, and means for repeatedly severing the web along spaced-apart predetermined fold lines which are located at a predetermined level above the bottom wall to thus separate from the pile a succession of stacks of coherent overlapping panels. The severing means comprises a substantially flat severing tool which is disposed at the aforementioned level and has a leader (e.g., in the form of an elongated cutting edge), and means for reciprocating the tool between a retracted position in which the leader is outwardly adjacent the first sidewall and an extended position in which the leader is outwardly adjacent the second sidewall whereby the leader automatically severs the web along a predetermined fold line which is adjacent the second sidewall at the aforementioned level. The apparatus further comprises means for spreading apart two superimposed fold lines which are adjacent the first sidewall, one of which is located above and the other of which is located below the aforementioned level to thus establish a clearance or gap for penetration of the leader of the severing tool between the spread-apart superimposed fold lines and toward severing engagement with the web along the predetermined fold line at the second sidewall, namely the fold line which is disposed between the spread-apart superimposed fold lines at the first sidewall.

The spreading means is preferably movable between an inoperative or inactive position outwardly adjacent the first sidewall and an operative or active position between the sidewalls, and the apparatus then further comprises means for moving the spreading means to the operative or active position prior to advancement of the leader of the severing tool beyond the first sidewall toward the second sidewall, i.e., into the interior of the duct and into the growing pile of overlapping panels in the duct.

In accordance with a presently preferred embodiment, the spreading means comprises a first spreading element which engages from below the upper fold line of the two superimposed fold lines, and a second spreading element which engages from above the lower fold line of the superimposed fold lines at the aforementioned level during movement of the spreading means to its operative or active position.

The spreading means can further comprise means for shifting the second spreading element between a raised position adjacent and a lowered position spaced apart from the first spreading element. The shifting means is operative to maintain the second spreading element in raised position during movement of the spreading elements between the superimposed fold lines at the aforementioned level, and to thereupon move the second spreading element to the lowered position in order to separate the superimposed fold lines and to thus establish the aforementioned clearance for penetration of the leader of the severing tool into the pile of overlapping panels on its way toward the extended position. In accordance with a presently preferred embodiment, the shifting means can comprise means for pivoting or rocking the second spreading element relative to the first spreading element.

In accordance with an advantageous feature of the invention, the improved apparatus can further comprise means for clamping at least two panels above the upper fold line of the superimposed fold lines at the first sidewall against the first spreading element, at least in the operative position of the spreading means. The means for moving the spreading means between the operative and inoperative positions can include means for moving the clamping means with the first spreading element. The clamping means can comprise a clamping member above the first spreading element and means for moving the clamping member up and down, i.e., away from and toward the first spreading element.

The apparatus can further comprise an elevator to be used as a means for raising the bottom wall and for lowering the bottom wall (at the rate of growth of the pile on the bottom wall) between an upper end position adjacent and beneath the aforementioned level and a lower end position. Such apparatus preferably further comprises means (e.g., an endless belt or chain conveyor) for receiving successive separated stacks from the bottom wall of the duct in the lower end position of the bottom wall, and means for transferring stacks from the bottom wall onto the receiving means in the lower end position of the bottom wall.

The bottom wall can include a central or median section having a panel-supporting upper side, a first marginal section having a panel-supporting upper side and being disposed beneath the first sidewall of the duct, and a second marginal section having a panel-supporting upper side and being disposed beneath the second sidewall The apparatus then further comprises means for moving the marginal sections between first positions in which the upper sides of the marginal sections are at least substantially flush (coplanar) with the upper side of the median section to predictably support the lowermost or foremost panel of the pile in a substantially horizontal plane, and second positions in which the upper sides of the marginal sections slope downwardly from the adjacent edges of the upper side of the median section toward the respective sidewalls. The means for moving the marginal sections preferably includes means for moving the marginal sections incrementally from the first to the second positions, preferably at a rate which is proportional to the rate of growth of the pile on the bottom wall. This ensures that the panels of the pile are at least substantially horizontal at the aforementioned level and facilitates forward movement of the leader of the severing tool toward the extended position without damaging or shifting the panels which are adjacent the clearance. The means for moving the marginal sections of the bottom wall of the duct preferably includes means for pivoting the marginal sections between their first and second positions.

The aforementioned means for shifting the second spreading element of the spreading means can serve several purposes, namely the aforementioned purpose of establishing a clearance between two superimposed fold lines at the first sidewall, and of cooperating with the bottom wall to clamp the panels between the clearance and the bottom wall, at least during advancement of the leader of the severing tool to its extended position. This further reduces the likelihood of undesirable shifting of the panel which is located immediately below the clearance. At the same time, the aforementioned clamping member cooperates with the first or upper spreading element to clamp at least two panels, namely the panels which are connected to each other by the upper fold line of the two superimposed fold lines at the first sidewall, to thus ensure that each of the two panels which flank the clearance is held against any lateral displacement as a result of penetration of the leader of the severing tool into and beyond the clearance which is established by the two spreading elements.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
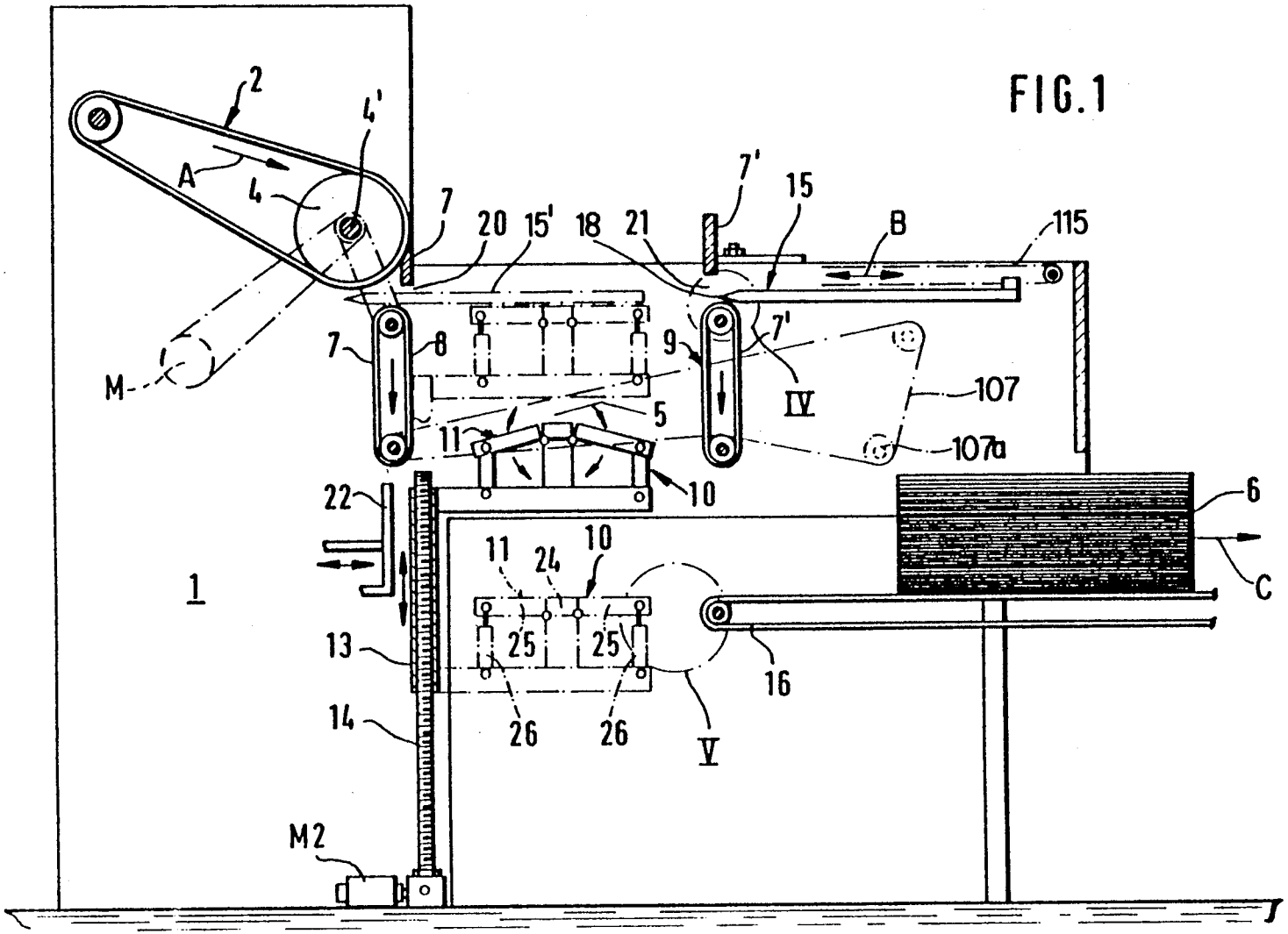
FIG. 1 is a schematic partly elevational and partly vertical sectional view of an apparatus which embodies one form of the invention, the severing tool and the bottom wall of the duct being shown in two different positions and certain parts of the apparatus being omitted for the sake of clarity.
Figure 2:
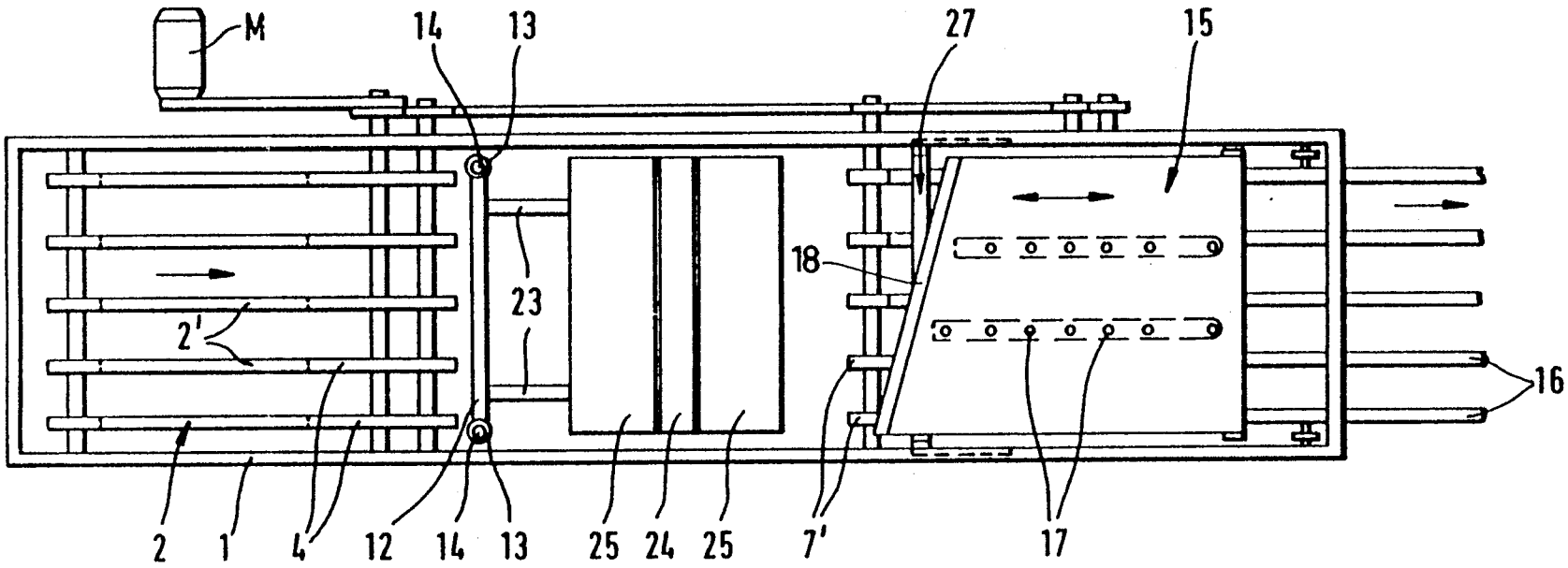
FIG. 2 is a plan view of the apparatus of FIG. 1.
Figure 3:
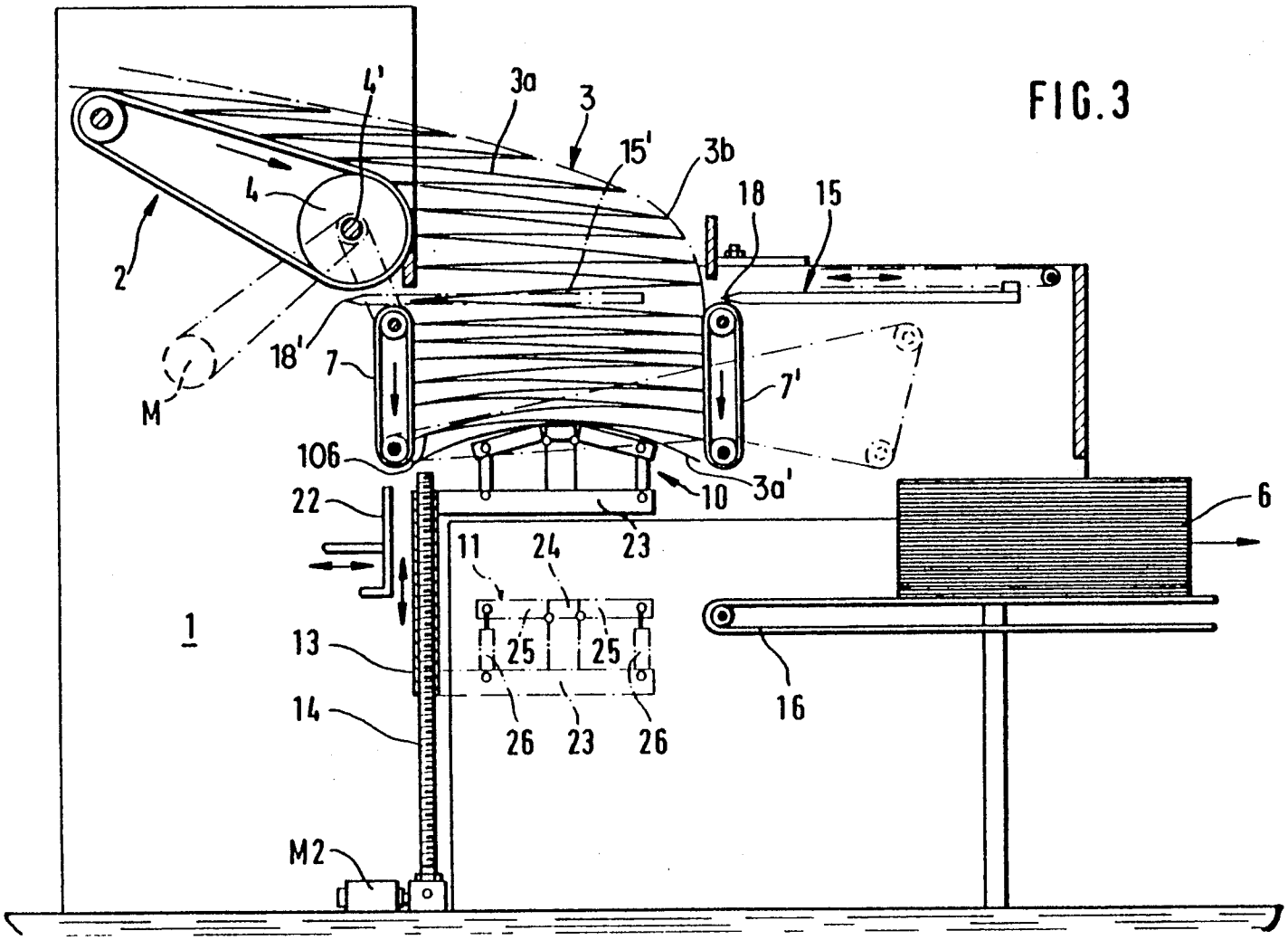
FIG. 3 is a view similar to that of FIG. 1 and further showing the web and a growing pile of superimposed overlapping panels in zig-zag formation above the bottom wall of the duct.

Referring first to FIGS. 1 to 3, there is shown an apparatus which can convert a continuous running web 3 of coherent panels 3*a* into a series of stacks 6 each of which contains a predetermined number (e.g., 500) of panels in zig-zag formation. The improved apparatus comprises a frame or housing 1 which supports a conveyor 2 serving as a means for advancing the web 3 into an upright duct 5 which has an open top to provide an inlet for entry of successive panels 3*a* which, at that time, form a scalloped stream of partially overlapping panels (FIG. 3). The frame 1 further supports a deflector or directing means including a horizontal shaft 4′ which is driven by a motor M, and a set of wheels 4 which are mounted on the shaft 4′ and change the direction of advancement of the web 3 so that successive panels 3*a* are compelled to enter the duct 5. The wheels 4 can serve as pulleys for the individual belts 2′ (see FIG. 2) of the conveyor 2. The panels 3*a* which enter into and descend in the duct 5 gather into a growing pile 106 having a foremost or lowermost panel 3*a*′ resting on the upper side of a bottom wall 10 forming a vertically movable part of the duct 5.

The duct 5 further comprises two upright sidewalls 7 and 7′ which are or can be constructed in the same way as the similarly referenced sidewalls in the apparatus of U.S. Pat. No. 4,842,572. The right-hand sidewall 7′ includes a stationary upper portion at a level above a reciprocable flat horizontal severing tool 15 and a lower portion constituted by the downwardly moving left-hand reach or stretch of an endless belt 9. The left-hand sidewall 7 includes a stationary upper portion adjacent the wheels 4 and a mobile lower portion which is constituted by the right-hand reach or stretch of an endless belt 8. The lower pulleys for the belts 8, 9 are driven by an endless belt 107 which is trained over pulleys 107*a*. The confronting reaches of the belts 8, 9 are moved downwardly to thus promote the descent of panels 3*a* in the duct 5 toward the bottom wall 10.

Neighboring panels 3*a* of the running web 3 are connected to each other along fold lines 3*b* which are or can be weakened (e.g., by transversely extending rows of perforations) to facilitate separation of neighboring panels 3*a* from each other. Successive fold lines 3*b* between the panels 3*a* of the pile 106 in the duct 5 are alternatingly adjacent the sidewalls 7 and 7′ and are engaged and moved downwardly by the adjacent inner reaches of the respective belts 8 and 9. Each of these belts can consist of two or more narrower belts (see FIG. 3). The frictional engagement between the fold lines 3*b* and the adjacent belts 8 and 9 need not be pronounced and can be intermittent, as long as the belts ensure that the panels 3*a* which have entered the duct 5 are induced to descend toward the bottom wall 10.

At least one of the sidewalls 7, 7′ is preferably movable toward or away from the other sidewall in order to conform the width of the duct 5 to the sizes of the panels 3*a* forming the running web 3. For example, the entire sidewall 7′ can be moved toward or away from the sidewall 7. The exact nature of the means for moving the sidewall 7′ and/or 7 toward or away from the other sidewall forms no part of the present invention.

The duct 5 can further comprise two additional sidewalls (not shown) one of which is located in front of and the other of which is located behind the sidewalls 7 and 7′ (as seen in FIG. 1 or 3). This further enhances the accumulation of a pile 106 wherein the neighboring panels 3*a* accurately overlap each other. If the duct 5 is provided with additional sidewalls, the distance of such additional sidewalls from each other is preferably variable in order to enable the apparatus to properly process wider or narrower webs.

It is further possible to provide the duct 5 with means for vibrating and/or otherwise agitating the belts 8, 9 and/or the aforementioned additional sidewalls in order to promote the movement of successively admitted panels 3*a* toward the bottom wall 10 and to ensure that each unit height of the pile 106 above the bottom wall 10 contains a predetermined number of panels. For example, the belt 8 and/or the belt 9 can be agitated by one or more rotary eccentrics to thus promote rapid downward movement of panels 3*a* in the pile 106 toward the bottom wall 10. The latter comprises a transversely extending bar 12 (FIG. 2) the ends of which carry nuts 13 mating with two discrete upright rotary feed screws 14 forming part of an elevator which can move the bottom wall 10 between an upper end position (shown in FIG. 1 by phantom lines) close to but at least slightly below the level of the severing tool 15, and a lower end position (shown in FIG. 3 by phantom lines) in which a freshly formed stack 6 resting on the upper side 11 receiving belt conveyor 16 by a reciprocable pusher 22. The conveyor 16 delivers stacks 6 to the next processing station, e.g., into a wrapping machine (see commonly owned U.S. Pat. No. 4,449,349 granted May 22, 1984).

The feed screws 14 of the elevator are driven by a reversible motor M2. The means for reciprocating the pusher 22 is not shown in the drawing.

The bar 12 of the bottom wall 10 carries two arms 23 which support a composite plate which is the actual panel-supporting portion of the bottom wall 10 and comprises a median or central section 24 and two marginal sections 25 which flank the median section 24. The upper sides of the sections 25, 24, 25 jointly form the upper side 11 of the bottom wall 10, and such upper side supports the foremost or lowermost panel 3*a*′ of the pile 106 in the duct 5. The marginal sections 25 are pivotally connected to the adjacent portions of the median section 24 by horizontal hinges which extend at right angles to the plane of FIG. 1 or 3, and such marginal sections are movable by increments between first positions which are indicated in FIGS. 1 and 3 by phantom lines and second positions which are shown by solid lines. The means for pivoting the marginal sections 25 includes two fluid-operated or other suitable linear motors 26 which are mounted on the arms 23 and are or can be operated in automatic response to lowering of the bottom wall 10 so that the inclination of the marginal sections 25 relative to the median section 24 can increase proportionally with the height of the pile 106 in the duct 5. The upper sides of the marginal sections 25 are coplanar or nearly coplanar with the upper side of the median section 24 when the pusher 22 is ready to transfer a freshly formed stack 6 from the upper side 11 of the bottom wall 10 onto the removing conveyor 16, and the upper sides of the marginal sections 25 are also coplanar with the upper side of the median section 24 when the bottom wall 10 is moved to the upper end position close to the level of the severing tool 15. The upper side 11 of the bottom wall 10 can be said to assume a substantially convex or roof-shaped configuration when the bottom wall 10 descends toward its lower end position. This is desirable and advantageous because the two sets of fold lines 3b which are inwardly adjacent the sidewalls 7 and 7' increase the height of the corresponding portions of the growing pile 106 in the duct 5. The convexity of the upper side 11 of the bottom wall 10 grows proportionally with the height of the pile 106 so that the panels 3a which are located at the level of the severing tool 15 are disposed in or close to horizontal planes. This ensures that the severing tool 15 can be moved between its retracted position (such position is shown in FIGS. 1 and 3 by solid lines) and its extended position 15' (indicated by phantom lines) without affecting the appearance and/or the integrity of the adjacent panels 3a. The means for controlling the operation of the motors 26 which serve to pivot the marginal sections 25 of the bottom wall 10 can receive signals from a detector or sensor (not shown) which monitors the level of the bottom wall 10 to thus ensure that the convexity of the upper side 11 is at least substantially proportional to the difference between the height of the pile 106 along the sidewalls 7, 7' and the height of the pile midway between such sidewalls.

In order to gather a growing pile 106 of panels 3a in the duct 5, the elevator including the reversible motor M2 lifts the bottom wall 10 to the upper end position which is shown in FIG. 1 by phantom lines and in which the bottom wall (with its upper side 11 flat) is located immediately or closely below the level of the severing tool 15. The web 3 continues to run in the direction of arrow A so that successive panels 3a of the web enter the duct 5 by way of the inlet (open top) and the foremost panel 3a' comes to rest on the flat upper side 11. The elevator including the motor M2 lowers the bottom wall 10 at a rate which is proportional to the speed of movement of the web 3 in the direction of arrow A and to the size of the panels 3a. At the same time, the motors 26 pivot the marginal sections 25 of the bottom wall (either stepwise or uninterruptedly) so that the convexity of the upper side 11 grows from zero at a rate which is substantially or exactly proportional to the growing difference between the height of the central portion of the pile 106 and of the marginal portions of such pile along the sidewalls 7 and 7' (i.e., the combined height of the two sets of superimposed fold lines 3b which gather along the sidewalls 7 and 7'). The result of such pivoting of the marginal sections 25 relative to the median section 24 of the bottom wall 10 is that the panel or panels 3a which are located at the level of the severing tool 15 are flat or substantially flat, i.e., such panels are located in substantially horizontal planes. When a severing step is completed, i.e., when the bottom wall 10 supports a stack 6 which has been separated from the remaining portion of the web 3, the motors 26 are caused to return the marginal sections 25 to their first positions (in which the entire upper side 11 is at least substantially horizontal) preparatory to actuation of the pusher 22 in order to transfer the stack 6 from the bottom wall 10 (which is then maintained in the lower end position) onto the removing conveyor 16. At such time, the upper side of the conveyor 16 is at least substantially coplanar with the flat upper side 11 of the bottom wall 10.

Figure 4:
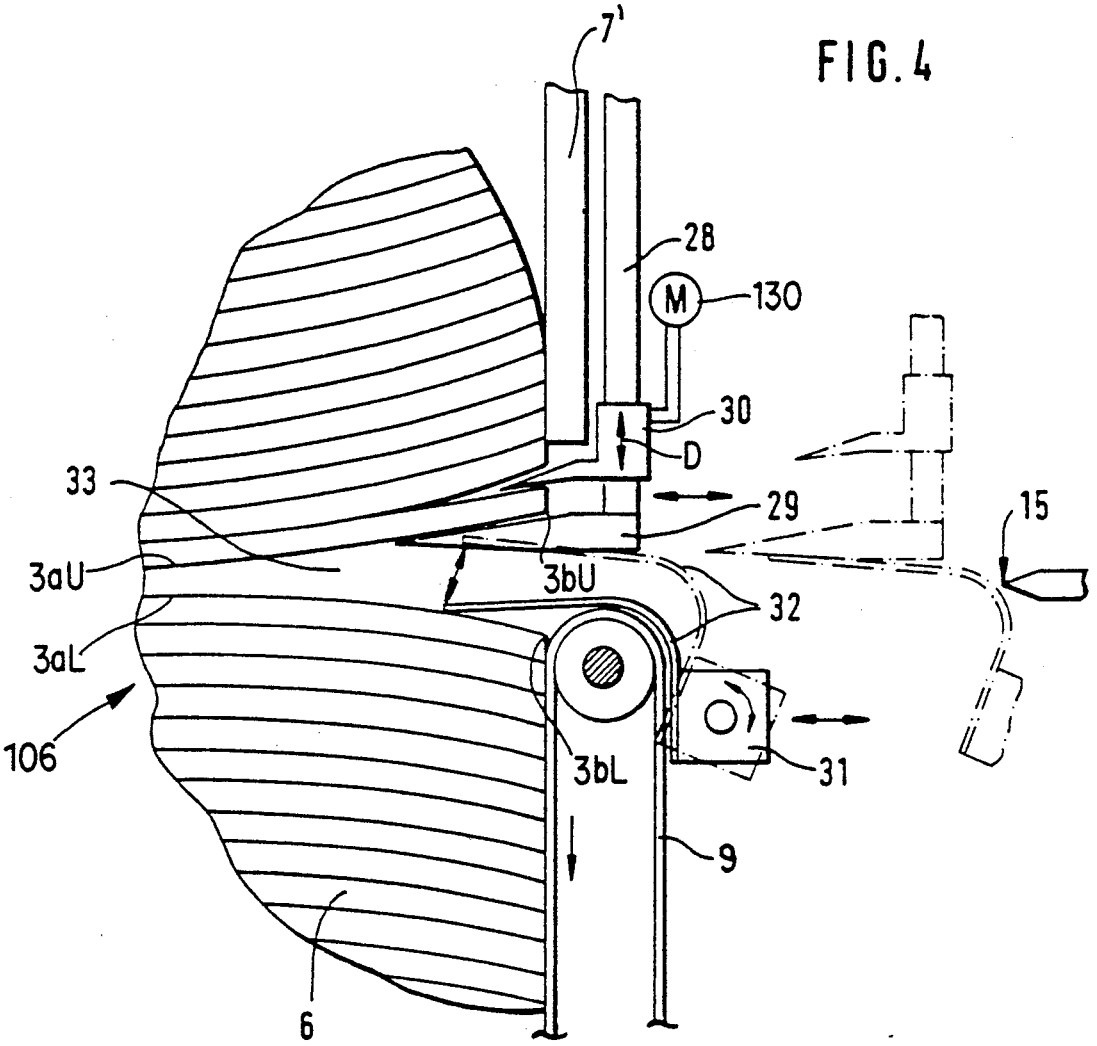
FIG. 4 is an enlarged view of the detail within the phantom-line circle IV in FIG. 1.

FIG. 4 shows certain details of a novel and improved mechanism which can spread the growing pile 106 at the level of the severing tool 15 before the latter is caused to move from the retracted to the extended position. This establishes a clearance or gap 33 at the sidewall 7' and greatly reduces the likelihood of damage to the panels 3aU and 3aL immediately adjacent the path of movement of the tool 15. In addition, the spreading mechanism cooperates with and can form part of a clamping device which clamps two or more panels 3a directly above and at least some or all panels 3a of a future stack 6 beneath the clearance 33.

The spreading mechanism comprises an upper spreading element 29, a lower spreading element 32 and a carriage 27 (see FIG. 3) which is reciprocable by a linear motor (not shown) to move the spreading elements 29, 32 toward and into the pile 106 ahead of the severing tool 15 and to thus establish the clearance 33. The carriage 27 supports one or more upright guide members 28 which support the upper spreading element 29. The lower spreading element 32 is mounted on a shifting member 31 here shown as a horizontal shaft which is mounted in the carriage 27 and can be pivoted or rocked back and forth in order to move the lower spreading element 32 between the solid-line and phantom-line positions of FIG. 4. When in the phantom-line position, the front end of the lower spreading element 32 is preferably received in a complementary recess in the underside of the upper spreading element 29. The spreading element 32 is maintained in such position during movement of the spreading elements 29, 32 toward and into the duct 5 at the level of the severing tool 15. This ensures that the front end of the substantially wedge-shaped upper spreading element 29 can readily penetrate between two neighboring superimposed fold lines 3bU and 3bL at the inner side of the sidewall 7'. The shaft 31 is thereupon caused to pivot the lower spreading element 32 to the solid-line position of FIG. 4 whereby the spreading elements 29, 32 automatically establish a clearance 33 which is ready to receive the leader 18 of the tool 15. At the same time, the lower spreading element 32 cooperates with the right-hand marginal section 25 of the bottom wall 10 to clamp the right-hand marginal portion of the future stack 6 above the bottom wall 10 so that the panel 3aL is reliably held in the position of FIG. 4 and cannot be entrained by the leader 18 when the leader is caused to move from the retracted position to the extended position 18'. The means for reciprocating the tool 15 between the retracted position (in which the leader 18 is located to the right of the sidewall 7' and outside of the duct 5) and the extended position 15' (in which the leader 18 assumes the position 18' and is outwardly adjacent the sidewall 7) can include a fluid-operated motor (such as that shown in U.S. Pat. No. 4,842,572) or an endless belt or chain conveyor 115 (FIG. 1). The directions of reciprocatory movement of the tool 15 are indicated by a double-headed arrow B.

In accordance with an additional feature of the invention, the upright guide member or members 28 on the carriage 27 support a vertically movable clamping member 30 which is movable up and down (arrow D) by a motor 130. The working end of the clamping member 30 is a wedge which penetrates between two neighboring superimposed fold lines 3b at the inner side of the sidewall 7' above the spreading element 29. The motor 130 is thereupon caused to move the clamping member 30 downwardly whereby the member 30 cooperates with the spreading element 29 to clamp at least two panels including the panel 3aU so that the latter cannot be entrained by the leader 18 when the severing tool 15 is caused to move toward the extended position 15'.

The initial position of the clamping member 30 (i.e., its distance from the spreading element 29) can be changed so that the member 30 can cooperate with the element 29 to clamp a larger number of panels 3*a* (including the panel 3*a*U) during movement of the tool 15 from and/or to the extended position 15'. FIG. 4 shows that the upper spreading element 29 is located immediately above the horizontal path of reciprocatory movement of the tool 15; this ensures that the clearance 33 is formed at the exact locus where the leader 18 of the tool 15 enters the duct 5 on its way toward the extended position 18'. At such time, the lower spreading element 32 is maintained in the solid-line position of FIG. 4, i.e., its working end is remote from the recess in the underside of the spreading element 29.

Figure 5:
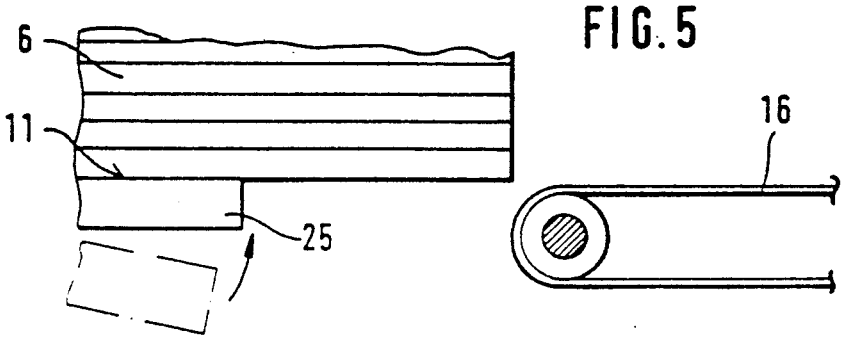
FIG. 5 is an enlarged view of a detail within the phantom-line circle V in FIG. 1.

FIG. 5 shows by solid lines the (horizontal) position of the pivotable right-hand marginal section 25 of the bottom wall 10 at the time the pusher 22 is in the process of transferring a freshly formed stack 6 from the bottom wall 10 onto the receiving conveyor 16. As mentioned above, at such time the flat upper side 11 of the bottom wall 10 is flush with the upper side of the upper reach of the conveyor 16. As shown in FIG. 2, the conveyor 16 can comprise several narrow endless belts or bands.

The leader 18 of the severing tool 15 has a cutting edge which is inclined relative to the fold lines 3*b* in the duct 5. This ensures that the tool 15 severs a predetermined fold line 3*b* (which is inwardly adjacent the sidewall 7 and is located at the junction of the panels 3*a*U and 3*a*L) starting at one end and proceeding toward the other end of such fold line. The illustrated severing tool 15 is a flat plate-like body (FIG. 2) which is located in a horizontal plane and is reciprocable in directions of arrow B. At the least the upper side of the tool 15 is or can be provided with a plurality of orifices 17 which discharge compressed air or another gaseous fluid to form a gaseous cushion between the tool 15 and the underside of the panel 3*a*U during movement of the tool 15 toward the extended position 15'. The orifices 17 receive compressed gas from a suitable source (not shown) by way of one or more flexible hoses which connect the source with one or more inlets at the trailing end of the tool 15. The sidewalls 7 and 7' are respectively provided with horizontal slots 20, 21 or similar passages to permit the tool 15 to move between its extended and retracted positions.

The operation is as follows:

When a stack-forming operation is to begin, the bottom wall 10 of the duct 5 is located in the upper end position, the upper sides of the marginal sections 25 are coplanar with the upper side of the median section 24 of the bottom wall 10, and the severing tool 15 is maintained in the retracted position. The spreading elements 29, 32 are withdrawn, together with the clamping member 30, so that the duct 5 is free to receive a series of coherent panels 3*a* starting with the panel 3*a*' which comes to rest on the (then) flat upper side 11 of the bottom wall 10. The running web 3 is deflected by the wheels 4 so that the direction of its movement changes from a movement in the direction of arrow A to a movement substantially vertically downwardly and into and beneath the open top of the duct 5. The elevator is set in operation, i.e., the motor M2 lowers the bottom wall 10 at a rate which is proportional with the speed of movement of the web 3 and hence with the rate of growth of the pile 106 in the duct 5. Analogously, the convexity of the upper side 11 of the bottom wall 10 increases at the same rate in order to account for the growing difference between the height of the marginal portions of the pile 106 along the inner sides of the sidewalls 7, 7' and the height of the central portion of the pile 106 above the median section 24 of the bottom wall 10.

The concavity of the underside of the foremost or lowermost panel 3*a*' (and of the adjacent panels 3*a*) is terminated by returning the marginal sections 25 into the plane of the median section 24 of the bottom wall 10 when the severing of the web 3 is completed.

When the height of the pile 106 between the bottom wall 10 and the plane or level of the tool 15 reaches the desired height of a stack 6 (i.e., when the number of panels 3*a* beneath the level of the tool 15) reaches a desired number, such as 500), the carriage 27 is moved from the retracted position to the extended position so that the spreading elements 29 and 32 (with the working end of the spreading element 32 extending into the recess in the underside of the spreading element 29) penetrate into the slot 21 of the sidewall 7' and between the adjacent superimposed fold lines 3*b*U, 3*b*L to establish the clearance 33 as shown in FIG. 4. At the same time, the wedge-shaped clamping member 30 penetrates into the pile 106 at a selected level above the spreading element 29 so that two or more panels 3*a* extend into the space between the member 30 and element 29. The motor 130 is then actuated to lower the member 30 so that the latter cooperates with the spreading element 29 to clamp the adjacent portions of the panels 3*a* (including the panel 3*a*U) between them. The shaft 31 is caused to pivot the lower spreading element 32 to the solid-line position of FIG. 4 as soon as the element 29 has penetrated into the pile 106 (such pivoting of the element 32 can but need not take place simultaneously with downward movement of the clamping member 30 under the action of the motor 130). Pivoting of the spreading element 32 results in the establishment of a clamping action upon the right-hand marginal portions of all panels 3*a* (including the panels 3*a*L and 3*a*') which are located beneath the clearance 33. The clamping action of the lower spreading element 32 is enhanced as a result of pivoting of the right-hand marginal section 25 of the bottom wall 10 back into a horizontal plane (see FIG. 5).

The next step involves actuation of the conveyor 115 to move the tool 15 from the retracted position to the extended position 15'. Such movement involves entry of the leader 18 into and a movement of the leader beyond the clearance 33. The inclined cutting edge of the leader 18 severs the web 3 along the fold line 3*b* which is located at the level of the tool 15 between the panels 3*a*U and 3*a*L in such a way that the severing operation begins at one end and progresses toward the other end of the slot 20. The leader 18 and/or any other part of the tool 15 cannot displace the panel 3*a*U and/or 3*a*L toward and into the slot 20 because these panels are clamped by the spreading elements 29, 32 in cooperation with the clamping member 30 and the right-hand marginal section 25 of the bottom wall 10. The clamping action takes place at the inner side of the sidewall 7' so that the tool 15 is highly unlikely to change the positions of the panels 3*a*U, 3*a*L while the leader 18 moves from the slot 21 toward and beyond the slot 20. The jets of compressed gaseous fluid which issue from the orifices 17 further reduce the likelihood of damage to and/or defacing and/or displacement of the panels which flank the clearance 33.

When the severing step is completed, the elevator motor M2 lowers the freshly obtained stack 6 to the position of FIG. 5 in which the (then) flat upper side 11 of the bottom wall 10 is coplanar with the upper side of the removing conveyor 16 and the pusher 22 is caused to transfer the stack 6 from the bottom wall 10 onto the conveyor 16. The next step involves lifting the bottom wall 10 to the level of the severing tool 15 which dwells in the extended position 15' so that it constitutes a temporary bottom wall for the growing pile 106 of panels 3*a* in zig-zag formation. The tool 15 is moved back to the retracted position when the bottom wall 10 reassumes its upper end position and the building of the pile 106 then proceeds in the aforedescribed manner. The cushion of gaseous fluid which is discharged by the orifices 17 of the tool 15 during return movement of the tool to its retracted position prevents any displacement, or any appreciable displacement, of the lowermost panel of the pile which is in the process of growing above the level of the tool.

The orifices 17 can be provided in addition to or in lieu of other friction reducing means. For example, the upper side and/or the underside of the tool 15 can be provided with a film or coat of friction reducing material (such as TEFLON, Trademark). Alternatively or in addition to such film and/or orifices 17, the tool 15 can carry layers of spherical or otherwise configurated friction reducing rolling elements which ensure that the tool cannot damage, deface and/or displace the adjacent panels 3*a* in the duct 5. It often suffices to treat the underside and/or the upper side of the tool 15 to a high degree of finish, such as by polishing or in any other suitable way.

The operation of the means for supplying the web 3 can be synchronized with the operation of the elevator for the bottom wall 10, with the operation of the conveyor 115 for the severing tool 15, with the operation of the linear motors 26, with the operation of the motor (not shown) for the pusher 22, with the operation of the motor for the carriage 27, and with the operation of the moving means 130 so that the improved apparatus is fully automated. The various motors can receive signals from suitable sensor means including a sensor which monitors the height of the pile 106 on the bottom wall 10, a sensor which monitors the speed of the conveyor, a sensor which detects the presence of the bottom wall 10 in the lower end position to start the motor for the pusher 22 and to thereupon start the motors 26 which return the marginal sections 25 of the bottom wall 10 into the plane of the median section 24, and so on.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing a continuous web of mutually inclined panels in zig-zag formation wherein neighboring panels are connected to each other along fold lines, comprising a substantially upright duct having an inlet and including spaced-apart first and second sidewalls and a bottom wall; means for advancing the web longitudinally toward and into said duct by way of said inlet so that the duct accumulates a growing pile of overlapping panels with the foremost panel of the pile resting on said bottom wall and the fold lines between successive panels alternatingly adjacent said first and second sidewalls; means for repeatedly severing the web along spaced-apart predetermined fold lines which are located at a predetermined level above said bottom wall to separate from the pile a succession of stacks of coherent overlapping panels, including a substantially flat severing tool disposed at said level and having a leader, and means for reciprocating said tool between a retracted position outwardly adjacent said first sidewall and an extended position in which the leader is outwardly adjacent said second sidewall whereby the leader severs the web along a predetermined fold line which is adjacent said second sidewall; means for spreading apart two superimposed fold lines which are adjacent said first sidewall, one of which is located above and the other of which is located below said level so as to provide a clearance for penetration of said leader between the spread-apart superimposed fold lines and toward severing engagement with the web along the predetermined fold line at said level, said spreading means being movable between an inoperative position outwardly adjacent said first sidewall and an operative position between said sidewalls and comprising a first spreading element which engages from below the upper fold line and a second spreading element which engages from above the lower fold line of the superimposed fold lines at said level during movement of said spreading means to said operative position; means for moving said spreading means to operative position prior to advancement of said leader beyond said first sidewall toward said second sidewall; and means for clamping at least two panels above the upper fold line against said first spreading element in the operative position of said spreading means.

2. The apparatus of claim 1, wherein said spreading means further comprises means for shifting said second spreading element between a raised position adjacent and a lowered position spaced apart from said first spreading element, said shifting means being operative to maintain said second spreading element in raised position during movement of said elements between the superimposed fold lines at said level and to thereupon move the second element to the lowered position in order to separate the superimposed fold lines and to establish said clearance for penetration of the leader of said tool into the pile on its way toward said extended position.

3. The apparatus of claim 2, wherein said shifting means comprises means for pivoting said second spreading element relative to said first spreading element.

4. The apparatus of claim 1, wherein said moving means includes means for moving said clamping means with said first spreading element

5. The apparatus of claim 4, wherein said clamping means comprises a clamping member and means for moving said clamping member up and down away from and toward said first spreading element

6. The apparatus of claim 1, further comprising means for raising and lowering said bottom wall between an upper end position adjacent and beneath said level and a lower end position, means for receiving separated stacks from said bottom wall in the lower end position of said bottom wall, and means for transferring stacks from said bottom wall onto said receiving means in the lower end position of said bottom wall.

7. The apparatus of claim 1, wherein said bottom wall includes a median section having a panel-supporting upper side and disposed between said sidewalls, a first marginal section beneath said first sidewall and a second marginal section beneath said second sidewall, each of said marginal sections having a panel-supporting upper side, and further comprising means for moving said marginal sections between first positions in which the upper sides of said marginal sections are substantially coplanar with the upper side of said median section and second positions in which the upper sides of said marginal sections slope downwardly from the upper side of said median section toward the respective sidewalls.

8. The apparatus of claim 7, wherein said means for moving said marginal sections relative to said median section includes means for moving said marginal sections incrementally from the first to the second positions thereof substantially proportionally with the growing height of the pile on said bottom wall.

9. The apparatus of claim 7, wherein said means for moving said marginal sections includes means for pivoting the marginal sections between said first and second positions thereof.

10. The apparatus of claim 1, further comprising means for shifting said second spreading element relative to said first spreading element to thus establish said clearance upon entry of said spreading elements between the superimposed fold lines at said first sidewall and to simultaneously clamp the panels between said second spreading element and said bottom wall.

11. Apparatus for subdividing a continuous web of mutually inclined panels in zig-zag formation wherein neighboring panels are connected to each other along fold lines, comprising a substantially upright duct having an inlet and including spaced-apart first and second sidewalls and a bottom wall; means for advancing the web longitudinally toward and into said duct by way of said inlet so that the duct accumulates a growing pile of overlapping panels with the foremost panel of the pile resting on said bottom wall and the fold lines between successive panels alternatingly adjacent said first and second sidewalls; means for repeatedly severing the web along spaced-apart predetermined fold lines which are located at a predetermined level above said bottom wall to separate from the pile a succession of stacks of coherent overlapping panels, including a substantially flat severing tool disposed at said level and having a leader, and means for reciprocating said tool between a retracted position outwardly adjacent said first sidewall and an extended position in which the leader is outwardly adjacent said second sidewall whereby the leader severs the web along a predetermined fold line which is adjacent said second sidewall; means for spreading apart two superimposed fold lines which are adjacent said first sidewall, one of which is located above and the other of which is located below said level so as to provide a clearance for penetration of said leader between the spread-apart superimposed fold lines and toward severing engagement with the web along the predetermined fold line at said level, said spreading means being movable between an inoperative position outwardly adjacent said first sidewall and an operative position between said sidewalls and comprising a first spreading element which engages from below the upper fold line, a second spreading element which engages from above the lower fold line of the superimposed fold lines at said level during movement of said spreading means to said operative position and means for shifting said second spreading element between a raised position adjacent and a lowered position spaced apart from said first spreading element, said shifting means comprising means for pivoting said second spreading element relative to said first spreading element and being operative to maintain said second spreading element in raised position during movement of said elements between the superimposed fold lines at said level and to thereupon move the second element to the lowered position in order to separate the superimposed fold lines and to establish said clearance for penetration of the leader of said tool into the pile on its way toward said extended position; and means for moving said spreading means to operative position prior to advancement of said leader beyond said first sidewall toward said second sidewall.

12. Apparatus for subdividing a continuous web of mutually inclined panels in zig-zag formation wherein neighboring panels are connected to each other along fold lines, comprising a substantially upright duct having an inlet and including spaced-apart first and second sidewalls and a bottom wall; means for advancing the web longitudinally toward and into said duct by way of said inlet so that the duct accumulates a growing pile of overlapping panels with the foremost panel of the pile resting on said bottom wall and the fold lines between successive panels alternatingly adjacent said first and second sidewalls; means for repeatedly severing the web along spaced-apart predetermined fold lines which are located at a predetermined level above said bottom wall to separate from the pile a succession of stacks of coherent overlapping panels, including a substantially flat severing tool disposed at said level and having a leader, and means for reciprocating said tool between a retracted position outwardly adjacent said first sidewall and an extended position in which the leader is outwardly adjacent said second sidewall whereby the leader severs the web along a predetermined fold line which is adjacent said second sidewall; means for spreading apart two superimposed fold lines which are adjacent said first sidewall, one of which is located above and the other of which is located below said level so as to provide a clearance for penetration of said leader between the spread-apart superimposed fold lines and toward severing engagement with the web along the predetermined fold line at said level, said spreading means being movable between an inoperative position outwardly adjacent said first sidewall and an operative position between said sidewalls and comprising a first spreading element which engages from below the upper fold line and a second spreading element which engages from above the lower fold line of the superimposed fold lines at said level during movement of said spreading means to said operative position; means for moving said spreading means to operative position prior to advancement of said leader beyond said first sidewall toward said second sidewall; means for shifting said second spreading element relative to said first spreading element to thus establish said clearance upon entry of said spreading element between the superimposed fold lines at said first sidewall and to simultaneously clamp the panels between said second spreading element and said bottom wall; and means for clamping at least two panels above the upper fold line against said first spreading element in the operative position of said spreading means so that the panels which are immediately adjacent said clearance cannot be shifted by the leader of said tool during penetration of the leader into said clearance and toward the extended position thereof.

* * * * *